US005372276A

United States Patent [19]

Daneshvar

[11] Patent Number: 5,372,276

[45] Date of Patent: Dec. 13, 1994

[54] AUTOMATIC PILL DISPENSER

[76] Inventor: Yousef Daneshvar, 21459 Woodfarm, Northville, Mich. 48167

[21] Appl. No.: 51,974

[22] Filed: Apr. 26, 1993

[51] Int. Cl.[5] ..... G07F 11/00

[52] U.S. Cl. ..... 221/2; 221/15

[58] Field of Search ..... 221/2, 3, 6, 9, 15, 221/79, 81, 123, 186–189, 266

[56] References Cited

U.S. PATENT DOCUMENTS

| | | | |
|---|---|---|---|
| 3,651,984 | 3/1972 | Redenbach | 221/3 |
| 4,674,651 | 6/1987 | Scidmore et al. | 221/15 |
| 4,695,954 | 9/1987 | Rose et al. | 221/3 |
| 4,838,453 | 6/1989 | Luckstead | 221/15 |
| 4,870,799 | 10/1989 | Bergerioux et al. | 221/2 |
| 5,221,024 | 6/1993 | Campbell | 221/15 |

FOREIGN PATENT DOCUMENTS

| | | | |
|---|---|---|---|
| 4018693 | 1/1992 | Japan | 221/3 |

*Primary Examiner*—Kenneth W. Noland

[57] ABSTRACT

The progress of medicine has brought with it the presence of many potent pills that are to be taken with a great accuracy. If these medications are not taken as ordered under or over medications will occur which can be serious. Also the progress of medicine has increased the longevity of the patients and the people live longer with use of many of these medications. However many times living longer is also complicated with weakness of memory which at times happens even in young age. At this point then at time a patient forgets about taking medications and sometimes does not know if has or has not taken a pill. This is at least worrisome if not dangerous and for these reasons this application introduces an automatic reminder for taking the pills as well as an automatic pill dispenser that is to help people to be able to be notified about timing of their medications and also to dispense them regularly. Although the patients with severe degree of impairment of their memory would not be able to use this system. However this is believed to be very useful in helping patients who have some but not a gross impairment of their memory. The inventor presents this as a unit which will help the human beings.

21 Claims, 5 Drawing Sheets

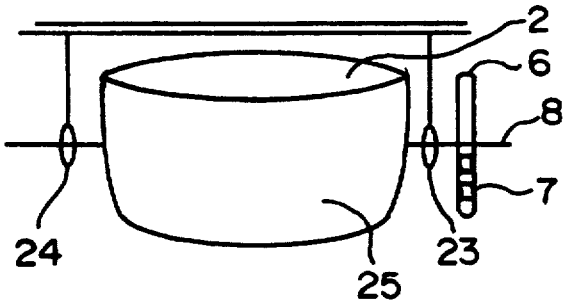
FIG. 3
FIG. 4
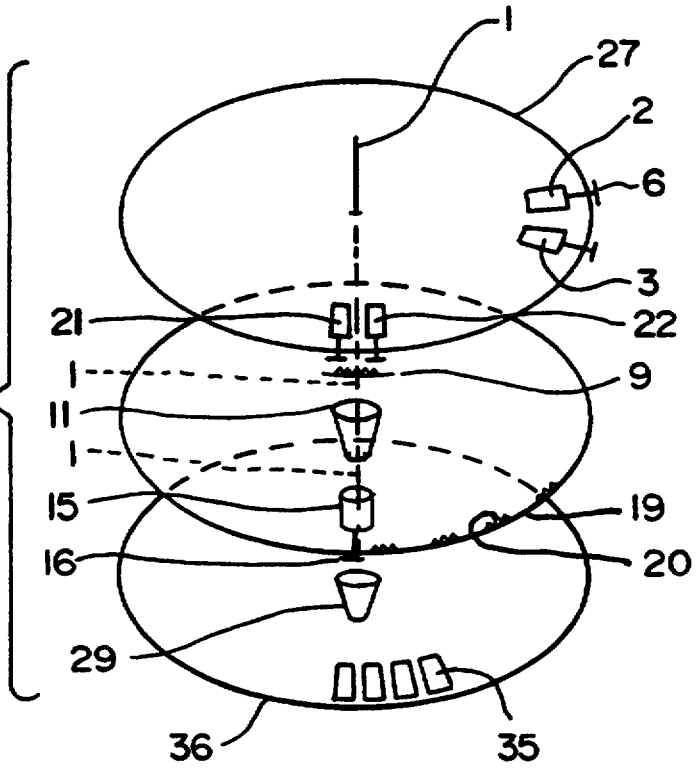

AUTOMATIC PILL DISPENSER

THE BACKGROUND THIS INVENTION

The human life is mixed with having different diseases which fortunately many are controlled or cured with medications. However unfortunately one problem with taking medications is that the people forget about the timing of the medications and then get confused about taking them. This brings problems such as over dosing, under dosing, and confusion of if a patient took an extra medication, or he missed a dose. In my own practice of medicine I have been called by panicked patients many times when they did not know what they have done with their medications, the patients did not remember weather they had taken their medications or not. I have admitted patients to the hospital due to accidental overdose of medications and this has thought me a lesson that there is a problem that needs to be solved. And this application is for such potential solution to help patients to organize their one week medications and to receive them on regular basis.

THE BRIEF EXPLANATION OF INVENTION

This invention deals with a machine that will allow the patient to have his medication to be dispensed on regular basis. For this purpose the patient will have his pills to be placed on a tray that has 28 smaller containers that then each group of four of them will hold the medications of one day starting from the AM dose, noon dose, PM dose and evening doses. These medications will be dispensed on each dose basis. That is there will be a door that will open and allow a patient to remove his AM dose then it will close and at noon the door will open and allow the patient to pick up his noon dose and will close again until next dose is to be taken. If a dose of medications would not be taken then it will be dumped inside special small containers that by their color coding and markings such as Tuesday PM dose, Wednesday AM dose, etc. that will indicate which dose of medicines were missed by the patient. So that an observer will be able to know exactly which dosing was missed. This dispenser will allow the persons medications to be organized for one week. And it can be locked when is wished. Beside this automatic dispenser, this application also introduces a mechanical or mini computer programed cassette recorder or similar machines to be made to produce a alarm or voice that will notify patient about the medications that are to be taken. This may also contain a special noise or massage to be announced aimed to help patient emotionally, spiritually or otherwise.

THE FIGURES

Please notice that the numbers in the figures are not continuous. This is intentional to prevent from duplication of numbers to occur also to give the chance of adding new numbers to existing ones if in the future it came to be necessary.

Figure 1:
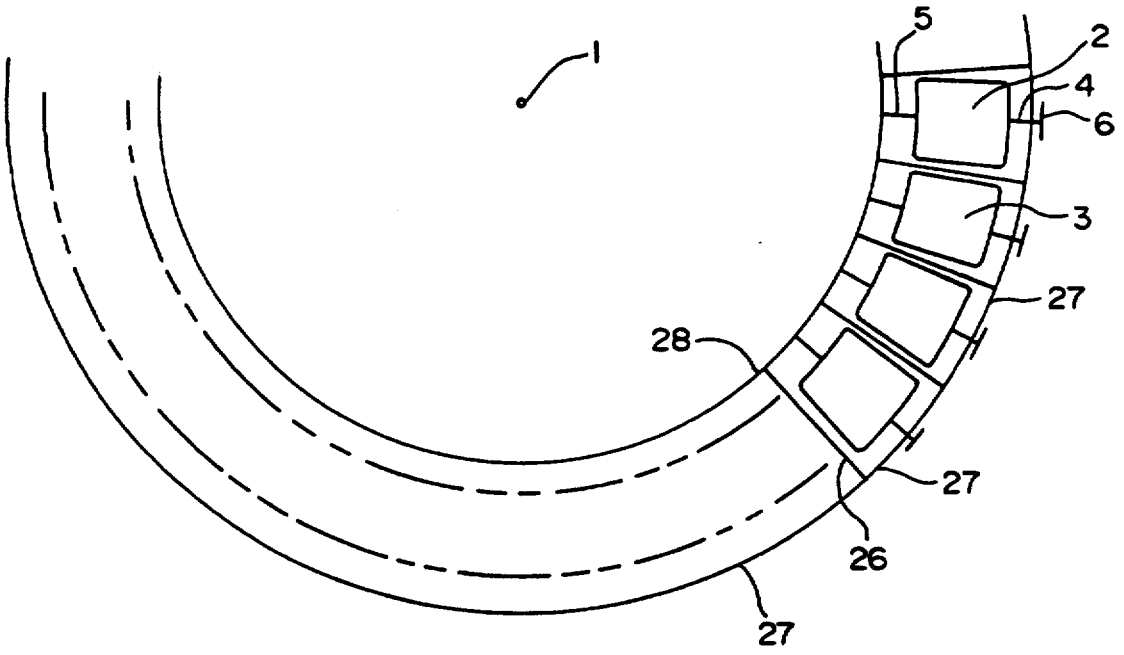

FIG. 1. This figure shows the top view and the general look of the upper tray which is to hold the medications of one week in its 28 small containers (this fig is the picture of only the lower half and the whole unit will be the full circle). The small containers of this tray are to be filled in the beginning of the week and the medications for each day to be filled in each small containers with their special dosage, coloring of the container and its marking sings in mind. So that the container of the medication for the Monday morning will be special and the container of the Tuesday evening as well etc. This upper tray may have number of trays and here it is designed to have total of 28 small containers, however this tray can be replaced with different number of containers and programs of medication plans. So that if a person wants to use mediations three times a day or twice a day or once a day still can use the automatic dispenser machine.

In this figure the center of the tray is shown by no 1. The individual small container by 2 and with another small container next to it by 3. The axle that holds the container 2 in the tray is shown by 4 & 5. The axle 4 connects to the outside of the container 2 and axle 5 connects to the inner wall of the container 2. The axle 4 goes thorough the outer rim of 27 to connect to the piece 6 that is an important part in causing the small container to rotate and to empty its inner contents. Each one of these small containers can rotate around these two axles as mentioned. The connecting piece 26 is the bridge between the outside rim of the upper surface tray 27 and it's outer circular rim 28.

Figure 2:
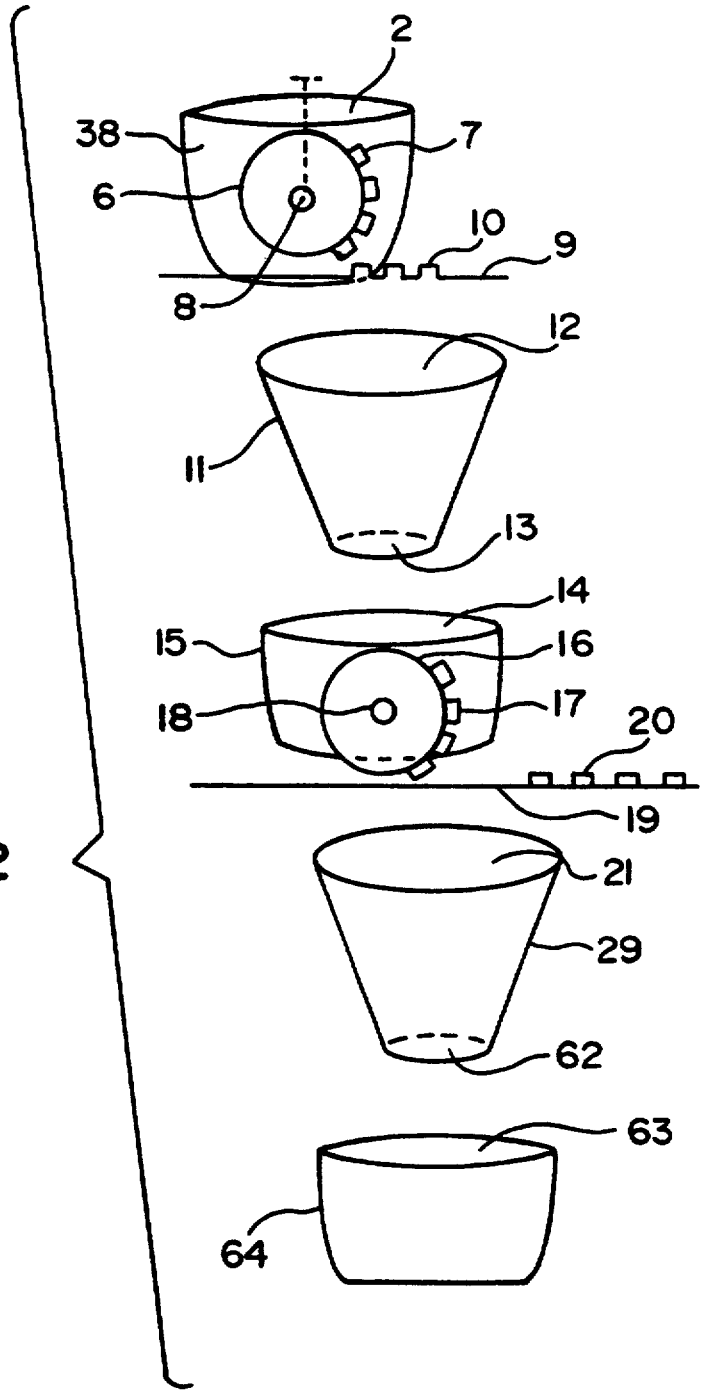

FIG. 2. This figure shows some important parts of the automatic dispenser machine in sequence. The upper part of this view shows the side view of one of the small containers of the upper try as mentioned earlier and is to hold the medication. This container will rotate and dump the medications into the funnel 11 and the funnel 11 will take the medications to the opening 14 of the container 15. This is referred as the "Pill server" and is a place where will be available to the patient and will allow the pills to be removed from it. If the patient did not remove the pills on timely basis then the pills will be dumped into the opening 21 of the lower funnel 29. This funnel then will pour the pills into the small container of the lower tray which is not shown here.

In this figure one of the small containers of the upper try is shown by 38 and its opening by 2 the tip of the axle 4 is shown by 8, the piece 6 is shown with part of it that has notches that will engage with matching notches of 10 from part 9 to cause the rotation of the container 8 and the dumping process to occur. The piece 9 is stable and fixed and would not move with time and naturally the notches 10 would not move either. However the upper tray is moving with scheduled speed to turn 360 degree during one week (or periodically by computer programming). With rotation of the upper tray a calculated pre-scheduled moment will come that the small upper container 38 will meet the piece 9 and the notches 7 will be predictably engage with the matching notches 10 of the piece 9. This will cause the rotation of the container 38 around axle 5-4-8 so that at one point it will be upside down with all its containing pills to dump inside the opening 12 of the funnel 11. Then this funnel by it's lower opening 13 will direct the pills into the middle container here referred as the pill server. This pill server is a small container that will hold the pills until they are picked or otherwise to be dumped. This pill server is shown by 15 and it's upper opening is shown by 14 the tip of the axle that this container will rotate around it is shown by 18 the small circular piece responsible for rotation function of this container by 16 and one of it's notches by 17. Under this container is edge of a rotating circular piece (at times referred as middle tray) is shown by no 19 which will be round and about the same size of the upper tray and will also rotate by the central axis 1. in the periphery or the rim of this part there are periodic groups of notches shown by 20 (in this tray there will be 28 groups of such notches one for rotation of each time pills). The speed of motion of this middle tray will then be exactly as the speed of the upper tray. The rotation of the tray will bring the notches 20 to engage with the notches 17 and then to cause the rotation of the container 15 around the axle 18 and to dump its contents into the funnel 29 with its upper opening of 21. The pills then will be directed by lower opening of funnel 29 into one of the smaller containers of the lower tray here is shown by 64 with its opening 63.

FIG. 3. This figure shows the side view of the small container which has the general shape shared by the upper small containers as well as the pill server. This container has a body of 25 with opening 2 and one axle in each side that will allow rotation around that axis to occur. In one end this container has a piece 6 connected to it with it's own notches of 7 that will allow rotation mechanism to be possible. This figure is to give the idea that such a container can rotates around two axles by rotation of the small piece 6 due to engagement of the notches 7. This rotation will be 360 degree and then the materials inside the container will be dumped easily during this rotation.

FIG. 4. This figure shows tile general view of the important pans of a prototype of an automatic pill dispenser unit and its three circular pieces that will rotate around vertical axis 1. and the two funnels between them. In this figure the vertical axis 1 is shown in the top and middle, with its extension in dashed line marked by no 1 twice in the left side of the picture. The outer rim of the upper tray is marked by 27. To prevent from crowding only 4 of the small containers of the upper tray are shown in this picture. Two of the small container in fronts are shown marked by 31 and 32. and two of them in the right side of the picture. marked by 2 and 3. The extension of the axis of container 2 away from axle 1 is shown by 6. The piece 9 is located right under the front two small containers and is responsible for the rotation of any small containers that come in contact with this piece. Then under this piece the upper funnel 11 is shown, standing above the pill server shown by 15. This funnel will take the pill inside the Pill Server. The pill server has and extension that will end to a small piece 16 which is very similar to piece 6 from FIG. 3. And this piece 16 has also notches very similar to notches 7 of piece 6 FIG. 3. So that those are responsible and will allow the rotation mechanism of pill server to occur. Then there is another important piece which a circular piece (also referred as second tray in this application) which plays a big role in rotation of the pill server and it in shown in the middle by no 19 between the upper and the lower tray. This piece has periods of groups of notches that will be moving by the rotation of this tray along vertical axis no 1. naturally the circular speed of this tray will be exactly the same as the upper and lower tray. With rotation of this tray these notches will come to contact with the notches of piece 16 of pill server 15 and then they will get engaged with its notches to make the pill server to rotate 360 and then to be upside down and to dump its pills. Under the pill server then the lower funnel is located shown by no 29. Then under this lower funnel the lower tray which is again a circular piece is shown. This tray has multiple small containers similar to the containers in the upper tray except these small containers are fixed in this tray and would not rotate, however the tray itself will rotate by the same exact circular speed of the upper tray and the middle piece as well around the central vertical axis 1.

Figure 5:
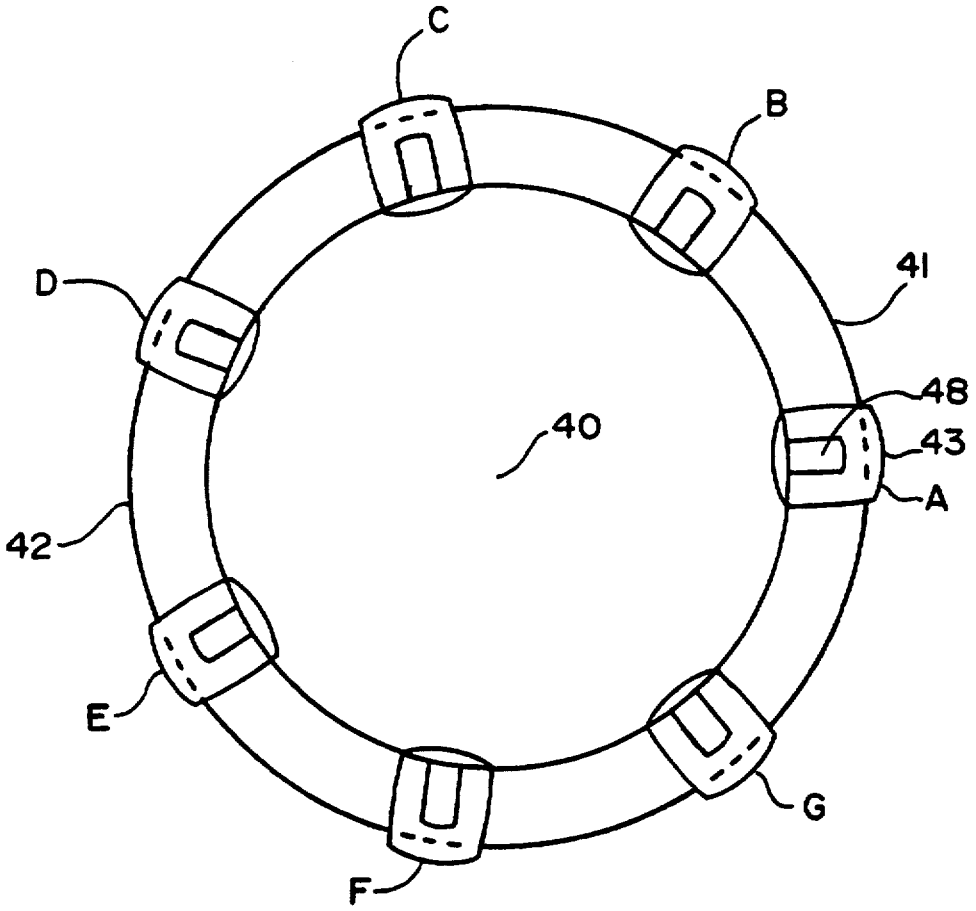

FIG. 5. This fig shows the top view of a circular special tray which is to allow the filling of the small containers with medications to be done with ease. This tray will have a center 40 to fit in the axis 1. This tray has a total of seven such funnels that are marked from A, B, C . . . till G. These seven special funnels will have a wider upper opening and a smaller lower part that will fit the upper rim of the small containers. In this fig the outer rim of the container m the right side of the fig is shown by 41 and in the left by 42 and the lower opening by 48 and the rim of the upper part by 43. Also seven of such funnels are shown marked by A, B, C, D, E, F, G. These are placed so that if the funnel A is in the morning dose container all the others will be in the morning dose containers as well, and if the funnel A is in the noon dose container all the others will be in the noon dose containers as well.

Figure 6:
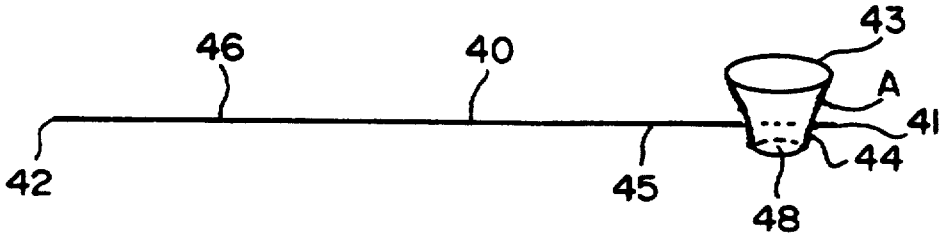

FIG. 6. This fig shows a cross cut of the same special tray which was shown in previous fig of 5. In this view the flat body of this unit is shown in the middle, and the very center of this tray is shown by 40 the upper surface of it by 46 and the lower surface of it by 45 in this figure only one of those seven special funnels are shown and that is the funnel A. The rim of the wider upper opening of this flannel is shown by 43 and the lower opening of that by 48. The outer rim of this tray in the right side of the fig is shown by 41 and in the left by 42.

Figure 7:
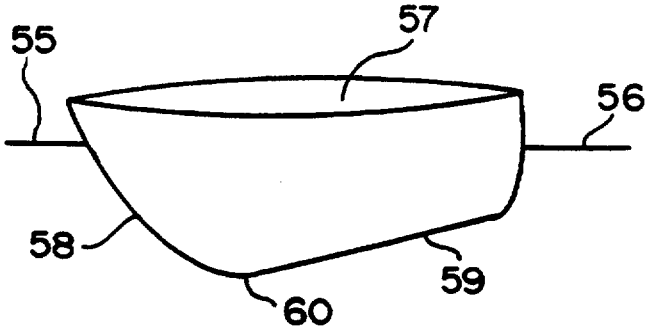

FIG. 7. This fig shows the side view of a pill server that has a special shape to allow easy removal of the pills by a special matching scoop to occur. This figure shows the opening of this pill server by 57 and the bottom surface of it by 58 and 59 and the deepest point of it by 60. This unit has two axles of 55 and 56 that will allow a circular motion of this piece to occur along them.

Figure 8:
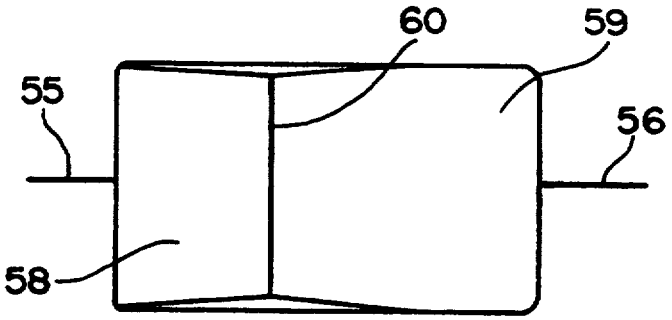

FIG. 8. This fig shows the top view of the pill server that was shown in previous fig of 7. This fig shown the bottom surfaces of 58 and 59 and the deepest point of it by 60. The two axles of 55 and 56 are also shown.

THE DETAILED EXPLANATION OF THIS INVENTION

One aspect of progress of medicine is that there are medications for different diseases, however they are potent and should not be missed or be taken extra. However unfortunately and commonly there is problem with memory of the very people who take the medications most, namely the elderlies who at times forget about the timing of their medications and then get confused about them. This brings problems such as over dosing, under dosing, and confusion of weather a patient took an extra medication or if missed a dose. I have been consulted by my patients in this regard many times, and it has captured my attention and it has made me to find a solution for it and this application is an attempt in this regard. This invention deals with a mediation dispensing machine that will hold the medications in separate dosing and will dispense it on pre-designed regular basis. Here a model is introduced that will dispense medications close to the same timing that are commonly dispensed in the hospitals, although this timing can be modified by different methods specially by use of computer programming. This machine will have a program that will allow the patient to have his pills to be dispensed on regular basis. For this purpose the patient will have his pills to be placed on a tray that has different containers and in this prototype it will have 28 smaller containers that are divided to seven groups of four container in each group. And each one of this seven group will contain the medications of one day, Sunday, Monday, Tuesday etc. And in each day starting from the AM dose, noon dose, PM dose and evening doses. After one day pills were dispensed then the other day will be started and will be continued in this fashion. These medications will be dispensed on each single dose basis. That is there will be a door that will allow a patient to remove his AM dose then in the noon for the patient to pick his noon dose and later the evening dose etc. If a dose of pills was not taken then it will be dumped into a special small container in the bottom which is designed to show which dose of the medication was missed by the patient. This will be done by having markings on each dumped small container such as Tuesday PM dose, Wednesday AM dose, etc. So that an alert patient or an observer will be able to find out exactly which dose was missed.

This dispenser will allow the persons medications to be organized for one week, with having them to be placed in color coded containers for each dosing of each day. For example there will be four small container for each day: one for AM dose, one for noon dose, one for PM dose, and one for evening dose. The container for the morning doses will be selectively colored, as well as each other doses. For example the container for the morning doses will be colored yellow, the noon doses Green, the PM doses pink and the evening doses Blue. Furthermore they will be marked for the days such as Sunday, Monday, Tuesday etc. So that the container for the morning of Sunday will be yellow and will say in its side that Sunday AM, dose. and the Tuesday PM container will be pink and in its side it will tell that Tuesday PM dose etc. So that at the time of filling the medication in containers it will be very easy to recognize the containers. Special color coding in some part of these small containers may also be made to show the days of the weeks as well and allow them to be recognized easily. This tray will be then moved by a pre-designed rate and the movement of this tray can be controlled by many possible ways including following ways:

1. Mechanical way: In this method the upper tray will be regularly and continuously rotated by an electronically powered engine designed to move one full circle during one week, so that it will move 360/7 degree each day. Such rotation will make it possible for the medications to be dumped in prescheduled bases and a back up battery will prevent from disruption of motion by power failure. In this methods all the three trays will move with exact same angular speed since they will be fixed and rotated around a central vertical axle marked no 1 in the FIG. 1.
2. The electronical way: In this case the rotation of the upper tray (or all the trays) can be controlled by use of mini computer which will be programed to allow certain degree of rotation to occur during each desired time. And the computer will control the function of a small electric engine that is responsible for the rotations of the trays, by different ways and one of them is to control its timing so that it will provide a controlled and predicted rotation of the upper tray around the central axle and also the middle and lower trays that are also connected to this axle will rotate as well.
3. Combinations of both of above mentioned methods: In this case the computer power for the programming and scheduling will be combined with the mechanical method. So that a suitable and useful combination will be made. For example in a model although the whole three trays will be joined and rotated by a central axle however the timing and rate of rotation of the whole unit will be guided and controlled by the computer. Also some other parts such as activation of the alarm may also be done by the computer or mechanical method as well.

Therefore the unit can be controlled by different ways and techniques. However in this advanced age of making computer the available computer chips and mini computers will allow a programming of many functions to be done by a small computer. And in these machines such advancement will be utilized so that every aspect of this programs could programed and changed easily. And with some modification of these basic ideas then every steps of such machine could be changed and altered as desired to make it the most useful for every patients and their need. Therefore with use of advanced chips it will be possible to program many steps of these transactions easily and precisely, and a small computer will be incorporated in the construction of this unit for such purposes.

So in this particular model with use of such computers the rotation of the trays can be done with an exchangeable rate and timing also the number of the functional trays (from 28 to 21 to 18 or even 8 based on the time distance placed between the use of the small containers) can be changed as well, so the timing between the doses can be then adjusted. The number of the containers can be adjusted as well for example the patient can be chosen to have a three times a day plan or twice a day plan instead of four times a day. So that the program can be customized to match the needs and medications to be dispensed on desired and needed basis.

The use of advanced micro chips and powerful mini computers in this regard are very useful and exciting and allows us to make similar and very useful units. For example one of such units also will be introduced here which is a computer unit made to inform patients about timing and use of their medications. In this case one of such computer that will be able to accept and function as a mulatto programmer will be connected to activate an alarm or a voice making system. What I mean is that the computer program will start an alarm or a machine of one kind or another that can make voice of human being such as cassette recorder or computer voices. So the computer will be able to start an alarm or a informing voice that will inform patients about the need for their medications to be taken. With the power of chips such planning can be done a week or a month a head even longer. In this method the computer can announce a friendly voice to say: Hello mother, Good morning it is time for you to take your morning medications. Do not forget them, and remember I love you more than the world. and this massage to be continued for a period of time until patient takes his/her medications and to press a bottom marked "Thank You" then the voice will stop but the function of the computer will continue till next dose such as noon dose. and the voice to come again to say: Hello mother, how are you it is time for you to take your noon medications. You know that I love you. and again this massage to be continued for a period of time until patient takes his/her medications and then to press a bottom marked "Thank You" and so on. Such noises can be actual recordings of patients relatives voice, and it will be then important to consider that it can have a very important psychological impact and help and support. In certain cases such as lonely persons a nice encouraging voice by itself can be curative and will have its own important therapeutic effect. It is important to notice that such massages can be changed and different nice and important things may be said.

In order to have this kind of computer with voice to be made the following methods can be used:

a. The computer to have a compartment for production of the voice and to allow the voice to be preserved and supplied by the digital or other computerized method and use.

b. In the other method the minicomputer will be used to control the activation of the function of a an electrical recorder to be done. And also to turn the machine off as well. This will allow a prerecorded massages to be heard when the unit turns on and then to be turned off after the massage is finished with having control of the timing. and the tape to be re-winded or to circulate and repeat the recorded noises everyday automatically. Naturally with recording different messages different goals and results can be achieved.

In these models mentioned above the purpose of use of such units will be to remind and encourage the patient to pick up the medications then it is expected that patient to pick up his/her medications. But in the case of automatic pill dispenser such a mini computer will be incorporated with the automatic pill dispenser, to control as its brain and the programmer as mentioned.

It is to be mentioned that similar type of units that is to activate a voice periodically can be made by mechanical methods. One such unit can be made by having a unit that will turn the cassette recorder on and off for period of time on pre-scheduled regular basis. Such a unit can be made by having a circular plastic nonconductor plate to rotate 360 degree during 24 hour and then to have pieces of conductors such as metal to go thorough two electrical pieces and to function as a conductor as long as it moving between them. This connection will cause a circuit to be complete and the recorder to be turned on and function during this period (for example 5–10 minutes or so) then when this piece is gone thorough the conduction will be disrupted and the cassette will stop, until the other conductive piece comes. The different placement of these conducting pieces will allow planning the time of such function to be changed. At the end the unit to make the recorder to rewind or the tape to circulate to continue the recorded massage again in another 24 hour and the cycle to repeat next day.

Continuing about the automatic pill dispenser it is planed to have a picture place next to the place which the pills are dispensed that will allow placement of the picture of the daughter or son or other loved one to be placed, the same person that is presumably relaying that massage.

Although the dispensed medications by this machine will be primarily pills and capsules but with use of a small capsules to act as the representative of the other medications {such as a small plastic capsule with a name of medications inside it to reefer to a medications that is not in pill form and should be taken or used, such as skin patch, eye drop, insulin, Metamucil etc. So that inside this capsule can be opened with a small tab of paper to be sticked on it and then the plastic cover to be closed (similar to my previous invention as in pill illustrator) this will be used to remind patient to use that medication also.} to be done as well.

As far as the function of the automatic pill dispenser is concerned first an alert person has to fill up the small containers of the upper tray will medications of one week and set the appropriate timing and if needed to lock the unit. The unit will start to function and in timely basis the first small container will rotate and dump its pills or medication reminders that will come thorough the upper funnel into the pill server and at this time an alarm or voice will be activated to inform patient about the presence of the medications for consumption. Then the patient will have a reasonable time of about 60 minutes or so (this time may be modified) to remove the pills or medication reminder from pill server. Then the motion of the middle circular piece (which is like a round tray and here also is referred as being the middle tray) with its notches will cause rotation of the pill server and cause the medications inside it to be dumped into the lower funnel to direct them into another smaller container that is part of the lower tray and has the correct marking to show which medication was missed. It should be considered that if the patient failed to pick up the pills and medication reminder during this period of time then they will be dumped into lower funnel otherwise the pill sever will rotate but there will be nothing left to dump. The dumping function will be done due to precise timing and planing and placement of the lower small container trays in concert with the upper set of trays. So that the medication of Tuesday PM dose will be dumped finally (and if not picked up by patient) into a small container that has the same coloring and marking of Tuesday PM dosing. And if the medication of Wednesday morning was missed it will be dumped into a yellow colored container marked with the Wednesday Am dose on it. This method will allow the recognition of the medications that are missed to be done easily. A clear window may allow the person to find about the medication or a special sign will let the person to recognize about this important event.

In order to facilitate the function of filling the medications in upper tray, this unit will come with a special tray with multiple funnels (in this case seven funnels) and this tray will fit on top of the small containers of each day to help in placement of medications in the beginning. So that the person can place this tray on the top of yellow colored containers to fill all the morning doses. Then to switch to green colored containers and fill the noon doses and then the pink containers for the PM doses etc. This is to make the job of filling the trays easy and less time consuming. So importantly there will be a tray that will have different number of small containers in order to allow series of the medications to be placed (in this case the tray will have 7 of such series).

Some more details about the technical aspect of this invention. Here a prototype will be mentioned for a better illustration. In this prototype the unit will consist from an upper tray that has round circular shape and consist total of 28 different small containers of about 3 cm=width by 4 cm=length by 2.5 cm=depth or so that will have a curved edges and is to hold the medications of one dose. This tray will have an axle one in one end similar to one shown in FIG. 1 no 5 and the other one by 4 in the same figure that will allow the rotation around that axis to occur. The axle 4 will be connected to small circular piece of 6 that has a number of notches on its periphery as shown better in FIG. 2 by no 7. The calculated placement of these notches gives the way for rotating the small container when the notches get engaged by another set of notches that are properly placed for the purpose such as one shown in FIG. 2 no 10 which are placed on the flat surface no 9. In this set the small containers shown by 38 which are located on the top tray will be rotating along the central axle 1 and the piece 9 will be stable and fixed, so that when each one of the small containers approach this point they will rotate 360 degree to dump its contents and move. The rotation of these three trays: the upper, middle and lower trays around the main vertical axle no 1 FIG. 1. will be a calculated one to go around the circle slowly so that the circle will finish exactly in one week (although an slight deviation in one week would not damage the plan since the cycle will be started again for another week from scratch. Also the final rotation hour would not be critical to finish in the same exact time.) and again this rotation can be controlled either by an electrical engine with a battery back up or controlled by electrical programming or preferably by a computer programer. To be more precise an electrical engine will be used to rotate the outer rim of one of the three trays. Which then it will also rotate the two other trays as well, when they are fixed to the main vertical axle no 1.

So there will be a step one that with the rotation of the upper tray the small containers will come into contact with fixed notches of 10 from base 9. in order to rotate 360 degree and to dump their pills into the upper funnel on pre-designed sequential basis and then another step: step two to be started.

Step 2. In this step the delivered medications from the original small container will drop into the upper funnel that will direct the medications into a single small special container here referred as the "Pill Server" no 15 FIG. 2. which will be exposed to patient, and patients will be educated to remove the dropped pills or medications from this container by a scoop. The pill server is shown in FIG. 2 by container 15 with its opening 14.

Shortly after the time which the medications are dumped into the pill server the system also activates an alarm or a voice or a sound to inform the patient that the pills are dispensed and should be taken. This can be initiated mechanically or by use of the computer controlled action. The notified patient then will remove the pills. At this point either the alarm will be shut off by the process of removing pills or a mechanism related to it, or it will be turned off by having patient to turn off the alarm by pressing a button which may say "thank you" and the alarm or the voice then to stay off till next activation. So that after the patient took the medications then the noise will stop. If the patient did not pick up the medication the noise will continue for a period of time, until about 5 to 10 minutes before the piles will be dumped into the lower place. Then the motion of the system will continue and rotate the pill server to dump it's medications into another or the second funnel or the "lower funnel" no 29 FIG. 2. designed to take those piles into another small container which is part of the "Dump Tray" no 36 FIG. 4.

Step 3. Step three will start after the pills are dumped into the lower funnel no 29 FIGS. 2 and 4 and it will direct the pills into the small containers such as no 35 FIG. 4 that has the same color and markings of the small container that the pills were originally dumped from. So there will be total of 28 small containers in the lower tray or the dump tray. This Dump Tray in a way is very similar to the upper tray except, this is to keep the dumped medications separate for an important purpose of letting patient or supervisor or a patient relative to notice which dose of medications if any were not picked up and consumed by the patient. And for this purpose the following differences between the upper tray and the lower tray will be true:

1. The individual units of the lower tray will not rotate along their own axis, simply since there is no need for it.
2. The individual units or the small containers of this tray will have the same coloring and markings to match the small container that originally has released the medications. This will give the method to let the supervisor or the patient to be able to learn which dose of medications were skipped and not taken, which is medically important and helps in decision making.

After the medications are dumped from the Pill server then the alarm or the voice will stop to start again after the second round of medications are delivered.

The cover of the unit in the lower side may be clear to allow inspection of the dumped medications to occur. Although this will be optional and a cover may be chosen to prevent it, considering the level of intelligence of the patient. Since in some cases it may seem to be wise to have the unused medications to be hidden to avoid from irritation of patient and his attempt to break the unit.

In order to prevent from the schedule to be interrupted if the electricity went off the unit may have a battery for back up function. And the battery may have an indicator to show its level of energy. The computer will be powered by a separate battery to prevent from the programming or its function to be disturbed if the electricity went off.

The pill server will be made to have a special curve in its bottom wall to be deeper in the end close to middle axle so that the pills to accumulate there to be picked up by an special scoop easily. This is shown in FIGS. 7 and 8 although the scoop is not shown here.

This unit will be covered by a nice cover made from metal or hard plastic to cover the whole unit, and to make it to look nice and it will have an opening for removing the medications. And there may be one or more locks used to prevent from opening unit without key. In some models the opening of the removal place for removal of the medications may have a door that may be closed expect for the time that the medications need to be removed this door may be controlled mechanically or electronically. The door may be made from rubber to prevent from hurting the patient's hand if it happened for patient to touch it.

Distribution tray: In order to allow easy distribution of the mediations in the upper tray to be done a special distributing tray is designed that will fit on the top of the upper tray. This is shown in FIGS. 5 and 6. and is a special circular tray which has number of funnels that will match the number of the similar series of units in each tray. In this case since medications are arranged for one week it will have seven of such funnels marked from A, B, C . . . till G. These seven special funnels will have a wider upper opening and a smaller lower opening. The opening of the lower part will match and fit the upper rim of the small containers of the upper tray. In this fig the outer rim of this distributing tray in the right side of the fig is shown by 41 and in the left by 42 and the lower opening of the funnel by 48 and the rim of the upper part by 43. By placing this distributing tray on the top of the upper tray the user or the supervisor will be able to pour the supply of the medications in each group easily. For example first to put medications of the AM containers. Then when all AM medications for the each day of the week is filled then to put the medications of noon for each day and to continue for PM doses and evening doses as well.

Importantly in certain models this unit may also be connected to a phone line and the arrangement to be made that if certain doses of pills were not picked up, that phone to be activated and a previously designed alarm or announcement to be transmitted through that phone to make the other person a supervisor or a relative or concerned person to be aware of this event. This will be very useful in cases that possibility of sudden death or sudden serious damage is high in a give patient and such alarming appears to be justified. Many mechanical or electronic techniques can be designed for such function to occur. For example the drop and presence of the pills inside the small containers of the lower tray can raise a lever or to activate a weight sensitive levers to initiate a mark or to turn one notch of a wheel of a system so that finally when certain number of notches are turned an electric system to be activated and massage to go. Or a photocell or series of photocells can be activated/de-activated so that again when certain numbers of activations are reached an electric system to be activated and massage to go by the phone.

It is of course understandable to consider that this unit can be modified to make other kinds of such units with using the methods and teachings and plans mentioned in this application. The use of Computer will be very exciting and helpful as mentioned and many uses can be made with the above mentioned teachings.

I claim:

1. An automatic pill dispenser comprising:

a succession of pill supply bins for containing supplies of pills;

a patient-accessible pill serving bin at which a patient can remove dispensed pills from the dispenser;

a succession of pill collection bins for collecting pills that have not been removed from said pill serving bin;

means for causing said pill supply bins to successively dispense their pills to said pill serving bin at timed dispensing intervals; and means for causing said pill serving bin to dispense in time delayed relation to its having been filled from a particular pill supply bin, and in time advanced relation to its being filled from the immediately succeeding pill supply bin, pills that have not been removed from it, to a particular pill collection bin that is correlated with such particular pill supply bin.

2. An automatic pill dispenser as set forth in claim 1 in which:

said succession of pill supply bins are arranged in a circular succession on an upper horizontal turntable that turns about a vertical axis;

said succession of pill collection bins are arranged in a circular succession on a lower horizontal turntable that turns about said vertical axis; and said pill serving bin is disposed vertically between said upper and lower turntables at a particular circumferential location about said vertical axis so that said pill supply bins and said pill collection bins move in succession past said pill serving bin as said upper and lower turntables turn about said vertical axis and pills are dispensed by gravity from said pill supply bins to said pill serving bin and from said pill serving bin to said pill collection bins.

3. An automatic pill dispenser as set forth in claim 2 in which:

each of said pill supply bins is mounted on said upper turntable by its own horizontal axle means such that each individual pill supply bin is caused to dispense pills that have not been removed from it by turning about its own axle means.

4. An automatic pill dispenser as set forth in claim 3 in which:

each horizontal axle means lies on a corresponding radial to said vertical axis.

5. An automatic pill dispenser as set forth in claim 3 in which:

said pill serving bin is disposed at such particular circumferential location for turning about its own horizontal axle means such that said pill serving bin is caused to dispense pills that have not been removed from it, to said pill collection bins by turning about its horizontal axle means.

6. An automatic pill dispenser as set forth in claim 5 in which:

each horizontal axle means of said pill supply bins and said horizontal axle means of said pill serving bin lie on corresponding radials to said vertical axis;

said means for causing said pill supply bins to successively dispense their pills to said pill serving bin at timed dispensing intervals comprises a toothed drive means disposed at a fixed circumferential location about said vertical axis proximate said upper turntable, and a toothed driven means on the axle means of each pill supply bin disposed for meshing with said toothed drive means as each pill supply bin is brought by said upper turntable to a position at which its pills are dispensed to said pill serving bin so as to cause said pill supply bin to turn about its axle means and dispense its pills to said pill supply bin; and said means for causing said pill serving bin to dispense in time delayed relation to its having been filled from a particular pill supply bin, and in time advanced relation to its being filled from the immediately succeeding pill supply bin, pills that have not been removed from it, to a particular pill collection bin that is correlated with such particular pill supply bin comprises a further toothed driven means disposed on said axle means of said pill serving bin, and a succession of further toothed drive means arranged in a circular succession on a further horizontal turntable that turns about said vertical axis for meshing in succession with said further toothed driven means so as to cause said pill serving bin to turn about its axle means and dispense pills that have not been removed from it in time delayed relation to its having been filled from a particular pill supply bin, and in time advanced relation to its being filled from the immediately succeeding pill supply bin, such that pills that have not been removed from said pill serving bin are dispensed to the particular pill collection bin corresponding to the particular pill supply bin that just filled said pill serving bin.

7. An automatic pill dispenser as set forth in claim 5 including a first funnel for funneling pills from said pill supply bins to said pill serving bin and a second funnel for funneling pills from said pill serving bin to said pill collection bins.

8. An automatic pill dispenser as set forth in claim 1 in which said pill supply bins are disposed at regular distance intervals and further including:

means for filling said pill supply bins with pills comprising a number of funnels disposed on a common funnel carrier at distance intervals equal to a whole multiple greater than or equal to two of the distance intervals between immediately successive pill supply bins so that when said funnels are registered with certain ones of said pill supply bins for filling, certain others of said pill supply bins are disposed between immediately successive funnels.

9. An automatic pill dispenser as set forth in claim 8 in which that portion of said carrier between its funnels covers the intervening pill supply bins between funnels.

10. An automatic pill dispenser as set forth in claim 1 in which a computer means controls at least some of the operational aspects of the dispenser.

11. An automatic pill dispenser as set forth in claim 1 including means to convey a message by telephone line to a person at a location that is remote from the dispenser to inform him or her that pills were not removed from said serving bin.

12. An automatic pill dispenser comprising:

a succession of pill supply bins for containing supplies of pills;

a patient-accessible pill serving bin disposed at a dispensing location at which a patient can remove dispensed pills from the dispenser;

pill collection means for collecting pills that have not been removed from said serving bin;

moving means for moving said pill supply bins in succession to said dispensing location and causing said pill supply bins to successively dispense their pills by gravity to said pill serving bin at timed dispensing intervals at said dispensing location; and means for causing said pill serving bin to dispense to said collection means in time delayed relation to its having been filled from a particular pill supply bin, and in time advanced relation to its being filled from the immediately succeeding pill supply bin, pills that have not been removed from it; and in which:

each of said pill supply bins is mounted on said moving means by its own horizontal axle means such that each individual pill supply bin is caused to dispense its pills by turning about its own axle means, and said means for causing said pill supply bins to successively dispense their pills by gravity to said pill serving bin at timed dispensing intervals comprises, a toothed drive means disposed at a fixed location proximate said moving means, and a toothed driven means on the axle means of each pill supply bin disposed for meshing with said toothed drive means as each pill supply bin is brought by said moving means to said dispensing location.

13. An automatic pill dispenser as set forth in claim 12 in which:

said pill supply bins are arranged in a circular succession on a horizontal turntable that turns about a vertical axis; and said pill serving bin is disposed vertically below said turntable at a particular circumferential location about said vertical axis so that said pill supply bins move in succession past said pill serving bin as said turntable turns about said vertical axis.

14. An automatic pill dispenser as set forth in claim 13 in which:

each horizontal axle means lies on a corresponding radial to said vertical axis.

15. An automatic pill dispenser as set forth in claim 14 in which:

said pill serving bin is mounted at its particular circumferential location for turning about its own horizontal axle means such that said pill serving bin is caused to dispense pills that have not been removed from it to said pill collection means by turning about its horizontal axle means.

16. An automatic pill dispenser as set forth in claim 15 including a first funnel for funneling pills from said pill supply bins to said pill serving bin and a second funnel for funneling pills from said pill serving bin to said pill collection means.

17. An automatic pill dispenser as set forth in claim 16 in which said supply bins are disposed at regular distance intervals and further including:

means for filling said pill supply bins with pills comprising a number of funnels disposed on a common funnel carrier at distance intervals equal to a whole multiple greater than or equal to two of the distance interval between immediately successive pill supply bins so that when said funnels are registered with certain ones of said pill supply bins for filling, certain others of said pill supply bins are disposed between immediately successive funnels.

18. An automatic pill dispenser as set forth in claim 17 in which that portion of said carrier between its funnels covers the intervening pill supply bins between funnels.

19. An automatic pill dispenser as set forth in claim 12 including annunciator means for conveying information to a patient about pills dispensed by the dispenser.

20. An automatic pill dispenser as set forth in claim 19 in which said annunciator means comprises means for announcing a delivery of pills from a pill supply bins to said pill serving bin.

21. An automatic pill dispenser as set forth in claim 19 in which said annunciator means comprises means for giving a pre-existing audible message to the patient.

* * * * *